US006506010B1

(12) United States Patent
Yeung et al.

(10) Patent No.: US 6,506,010 B1
(45) Date of Patent: Jan. 14, 2003

(54) METHOD AND APPARATUS FOR COMPRESSOR CONTROL AND OPERATION IN INDUSTRIAL GAS TURBINES USING STALL PRECURSORS

(75) Inventors: Chung-hei (Simon) Yeung, Evansville, IN (US); Steven M. Schirle, Anderson, SC (US); Jonnalagadda Venkata Rama (JVR) Prasad, Roswell, GA (US)

(73) Assignee: General Electric Company, Schenecetady, NY (US)

( * ) Notice: Subject to any disclaimer, the term of this patent is extended or adjusted under 35 U.S.C. 154(b) by 0 days.

(21) Appl. No.: 09/835,825

(22) Filed: Apr. 17, 2001

(51) Int. Cl.[7] ..... F01D 00/00

(52) U.S. Cl. ..... 415/1; 415/17; 416/35; 416/42

(58) Field of Search ..... 415/1, 17, 119, 415/116, 914; 416/35, 36, 42, 61

(56) References Cited

U.S. PATENT DOCUMENTS 4,216,672 A * 8/1980 Henry et al. ..... 73/115
5,275,528 A * 1/1994 Freeman et al. ..... 415/1
5,340,271 A * 8/1994 Freeman et al. ..... 415/1
5,594,665 A * 1/1997 Walter et al. ..... 364/558
5,732,546 A * 3/1998 Pineo et al. ..... 60/39.03
5,915,917 A * 6/1999 Eveker et al. ..... 415/1
6,059,522 A * 5/2000 Gertz et al. ..... 415/1
6,226,974 B1 * 5/2001 Andrew et al. ..... 60/39.02
6,260,350 B1 * 7/2001 Horii et al. ..... 60/39.03
6,343,251 B1 * 1/2002 Herron et al. ..... 701/100
6,364,602 B1 * 4/2002 Andrew et al. ..... 415/1

* cited by examiner

*Primary Examiner*—Edward K. Look
*Assistant Examiner*—James M McAleenan
(74) *Attorney, Agent, or Firm*—Nixon & Vanderhye P.C.

(57) ABSTRACT

An apparatus for monitoring the health of a compressor including at least one sensor operatively coupled to measure the dynamic pressure of gases flowing through the compressor, a processing system coupled to at least one sensor, the processor system recording and processing the measurements made by at least one sensor. The apparatus further includes a comparator that compares the sensor measurements with predetermined baseline values, and a real-time controller coupled to the comparator, the controller initiating corrective actions to prevent a compressor surge if the sensor measurements deviate from the predetermined baseline values.

18 Claims, 4 Drawing Sheets

METHOD AND APPARATUS FOR COMPRESSOR CONTROL AND OPERATION IN INDUSTRIAL GAS TURBINES USING STALL PRECURSORS

BACKGROUND OF THE INVENTION

This invention relates to non-intrusive techniques for monitoring the health of rotating mechanical components. More particularly, the invention relates to a method and apparatus for monitoring and controlling the performance of an axial flow compressor or a gas turbine by detecting precursors to rotating stall and surge.

In gas turbines used for power generation, a compressor must be allowed to operate at a higher pressure ratio to achieve a higher machine efficiency. During operation of a gas turbine, there may occur a phenomenon known as compressor stall, wherein the pressure ratio of the compressor initially exceeds some critical value at a given speed, resulting in a subsequent reduction of compressor pressure ratio and airflow delivered to the combustor. Compressor stall may result from a variety of reasons, such as when the engine is accelerated too rapidly, or when the inlet profile of air pressure or temperature becomes unduly distorted during normal operation of the engine. Compressor damage due to the ingestion of foreign objects or a malfunction of a portion of the engine control system may also result in a compressor stall and subsequent compressor degradation. If compressor stall remains undetected and permitted to continue, the combustor temperatures and the vibratory stresses induced in the compressor may become sufficiently high to cause damage to the gas turbine.

The global market for efficient power generation equipment has been expanding at a rapid rate since the mid-1980's—this trend is projected to continue in the future. The Gas Turbine Combined-Cycle power plant, consisting of a Gas-Turbine based topping cycle and a Rankine-based bottoming cycle, continues to be the customer's preferred choice in power generation. This may be due to the relatively-low plant investment cost, and to the continuously-improving operating efficiency of the Gas Turbine based combined cycle, which combine to minimize the cost of electricity production.

It is well known that elevated firing temperatures enable increases in combined cycle efficiency and specific power. It is further known that, for a given firing temperature, an optimal cycle pressure ratio is identified which maximizes combined-cycle efficiency. This optimal cycle pressure ratio is theoretically shown to increase with increasing firing temperature. Axial flow compressors, which are at the heart of industrial Gas Turbines, are thus subjected to demands for ever-increasing levels of pressure ratio, with the simultaneous goals of minimal parts count, operational simplicity, and low overall cost. Further, an axial flow compressor is expected to operate at a heightened level of cycle pressure ratio at a compression efficiency that augments the overall cycle efficiency. An axial flow compressor is also expected to perform in an aerodynamically and aero-mechanically stable manner over a wide range in mass flow rate associated with the varying power output characteristics of the combined cycle operation.

Therefore, it would be desirable to have a reliable method and apparatus to determine the state/health of a compressor by determining the onset of a compressor surge prior to the event occurrence.

BRIEF SUMMARY OF THE INVENTION

Accordingly, the present invention solves the simultaneous need for high cycle pressure-ratio commensurate with high efficiency and ample surge margin throughout the operating range of a compressor. The present invention is particularly directed to a system and method for continuously monitoring and controlling the state of an axial flow compressor using stall precursors by varying the operating line parameters to account for compressor degradation thereby maintaining a predetermined level of compressor operability. A plurality of sensors are disposed about the compressor casing in a circumferential manner for measuring the dynamic pressure and dynamic velocity of gases flowing through the compressor. Measured data from the sensors is filtered and received by a real-time operating system for processing and storage. When the amount of stored data reaches a predetermined level, it is processed using a stall precursor detection algorithms to extract the magnitudes of the precursors. The precursor magnitudes are then compared with known baseline compressor values, and the difference is used to estimate a degraded compressor operating map. A corresponding compressor operability measure, i.e., operating stall margin, is computed and compared to a design target. If the operability of the compressor is deemed insufficient, corrective actions are initiated by a real-time control system which causes to vary the operating limit line parameters thereby reducing loading on the compressor in order to maintain the required compressor operability level.

Some of the corrective actions may include varying the operating line control parameters such as making adjustments to compressor variable vanes, temperature of inlet air, compressor air bleed, combustor fuel mix, etc. to operate the compressor at a near threshold level. Preferably, the corrective actions are initiated prior to the occurrence of a compressor surge event and within a margin identified between a operating line threshold value and the occurrence of a compressor surge event. These corrective steps are iterated until the desired level of compressor operability is achieved. The exemplary embodiment of the present invention as illustrated herein provides a design and operational strategy that provides optimal pressure ratio and surge margin not only for cases where the inlet guide vanes (IGV's) are tracking along the nominal full flow schedule, but also for cases where the IGV's are closed down for reduced flow under power-turndown conditions.

In one aspect, the present invention provides a method for monitoring and controlling a compressor, comprising the steps of: monitoring the pressure of gases flowing through the compressor; comparing the monitored pressure with predetermined baseline values to estimate compressor degradation; performing corrective actions to mitigate compressor degradation to maintain a pre-selected level of compressor operability; and iterating said corrective actions performing step until the monitored pressure lies within a predetermined threshold. The method further comprises performing signal processing on the monitored pressure to obtain a filtered pressure signal; and storing the filtered signal in a memory. The corrective actions are initiated by varying operating line parameters. The corrective actions include reducing the loading on the compressor. The operating line parameters are set to a near threshold value.

In another aspect, the present invention provides an apparatus for monitoring the health of a compressor at least one sensor operatively coupled to measure the dynamic pressure of gases flowing through the compressor; a processing system coupled to at least one sensor, the system recording and processing the measurements made by at least one sensor. The apparatus further includes a comparator that compares the measurements with predetermined baseline values; and a real-time controller coupled to the comparator, the controller initiating corrective actions to prevent a compressor surge if the sensor measurements deviate from said predetermined baseline values. The apparatus further includes a system selector whereby the measured signals are selectively applied to provide a visual warning of compressor degradation.

In another aspect, the present invention provides a method for continuously monitoring and controlling surge events in a compressor included in a gas turbine according to various embodiments of the present invention.

In another aspect, the present invention provides an apparatus for continuously monitoring and controlling an axial flow compressor system having means for measuring the dynamic pressure of gases flowing through the compressor; means for processing the dynamic pressure measurements by at least one precursor detection algorithm to calculate precursor signal magnitudes; means for comparing the precursor signal magnitudes with predetermined baseline values; and means for performing corrective actions if the precursor signal magnitudes deviate from the baseline values.

In yet another aspect, the present invention provides a method for continuously monitoring and controlling an axial flow compressor by providing a means for measuring the dynamic pressure of gases flowing through the compressor; providing a means for processing the dynamic pressure measurements by at least one precursor detection algorithm to calculate precursor signal magnitudes; providing a means for comparing the precursor signal magnitudes with predetermined baseline values; and providing a means for performing corrective actions if the precursor signal magnitudes deviate from said baseline values.

In yet another aspect, the present invention provides a stall precursor detector system for a gas turbine of the type having an axial flow compressor, the detector system having at least one sensor coupled to measure the dynamic pressure of gases flowing through the compressor; a processor system coupled to at least one sensor, the processor system including a precursor detection algorithm for processing the dynamic pressure data with predetermined baseline values; a comparator coupled to the processor system for comparing the sensor measurements with predetermined baseline values; and a real-time controller coupled to the comparator for performing corrective actions to prevent a subsequent compressor surge if the measured pressure deviates from the predetermined baseline values.

The benefits of the present invention will become apparent to those skilled in the art from the following detailed description, wherein only the preferred embodiment of the invention is shown and described, simply by way of illustration of the best mode contemplated of carrying out the invention.

DETAILED DESCRIPTION OF THE INVENTION

Figure 1:
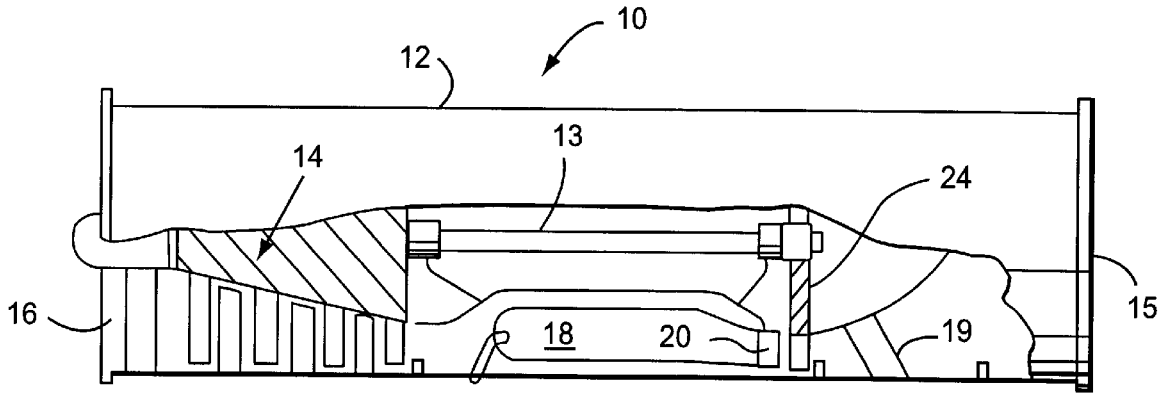
FIG. 1 is a schematic representation of a typical gas turbine engine.

Referring now to FIG. 1, a gas turbine engine is shown at 10 as comprising a housing 12 having a compressor 14, which may be of the axial flow type, within housing 12. The compressor 14 receives air through an annular air inlet 16 and delivers compressed air to a combustion chamber 18. Within the combustion chamber 18, air is burned with fuel and the resulting combustion gases are directed by a nozzle or guide vane structure 20 to the rotor blades of a turbine rotor 24 for driving the rotor. A shaft 13 drivably connects the turbine rotor 24 with the compressor 14. From the turbine blades, the exhaust gases discharge rearwardly through an exhaust duct 19 into the surrounding atmosphere.

Figure 2:
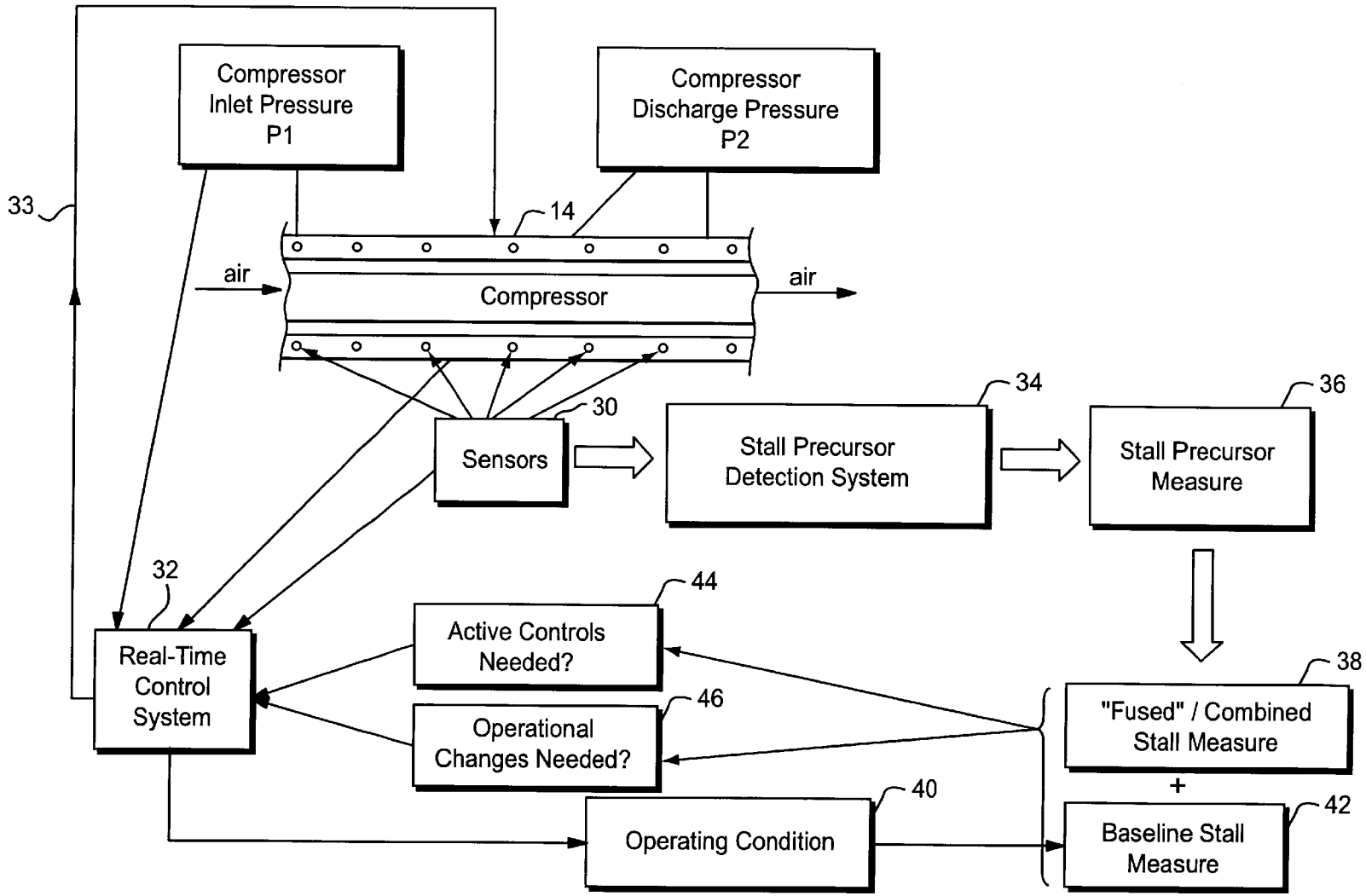
FIG. 2 illustrates a schematic representation of a compressor control operation using stall precursors.

Referring now to FIG. 2, there is shown in block diagram fashion the apparatus and method for continuously monitoring and controlling an axial flow compressor 14 by measuring the dynamic pressure and dynamic velocity of gases flowing through the compressor. A single stage of the compressor is illustrated in the present embodiment to better explain the inventive concept. In fact, several such stages may be present in a compressor. In the exemplary embodiment as shown in FIG. 2, sensors 30 are disposed about the casing of a compressor 14 for measuring the dynamic pressure/velocity of gases flowing through the compressor 14. The dynamic pressure/velocity data is fed to system 32 for processing and storage. Appropriate signal processing, such as filtering the signals is performed to clean the signals received by sensors 30. When the amount of stored data reaches a predetermined level, a stall precursor detection algorithm embodied in system 34 processes the received data from sensors 30 to extract magnitudes of the stall precursors as indicated at 36. Received data from sensors 30 may be processed using a plurality of stall detection algorithms operating in parallel, thus increasing the confidence of stall precursor detection. A number of stall precursor magnitudes obtained from respective sensors may be combined in a system 38, and the combined magnitude is compared with a combined baseline stall magnitude by system 42 to define an upper limit of compressor degradation. The real time control system 32 obtains pressure and velocity ratios from compressor 14 and calculates an operating condition of compressor 14 as indicated at 40. The baseline stall measures may be extrapolated from the knowledge of the operating condition of compressor 14.

The difference between measured precursor magnitude(s) and the baseline stall measure via existing transfer functions is used to estimate a degraded compressor operating map, and a corresponding compressor operability measure is obtained, i.e., operating stall margin is computed to compare to a design target. The operability of the compressor of interest is then deemed sufficient or not. If the compressor operability is deemed insufficient, then a request for providing active controls is initiated as indicated at 44, and control system 32 provides instructions for actively controlling compressor 14. Control system 32 may also inform an operator via maintenance flags or a visual warning, and the like regarding compressor operability. However, if it is determined that operational changes are required, appropriate Operating Limit Line required to maintain the design compressor operability level is estimated at 46 and the control system 32 issues actions on a gas turbine to reduce the loading on compressor 14. It will be appreciated that the compressor operability estimated at 46 may instead be provided to a decision making system (not shown) to provide appropriate indicators as noted above to an operator.

Active controls by control system 32 may be used to set operating line parameters for the operation of axial flow compressor 14. Once the operating line parameters are set, pressure and velocity of gases flowing through the compressor are measured—the measured values representing stall precursors. The measured values are filtered to remove noise and subsequently processed to extract the magnitudes. The extracted magnitudes are compared with predetermined baseline compressor values. If the extracted magnitudes deviate from the predetermined baseline values, then a signal indicative of compressor degradation is issued. Subsequently, corrective actions are initiated by varying the operating limit line parameters to cause the compressor to function with a desired level of operability. Corrective actions are iterated until the desired level of operability is achieved.

Figure 4:
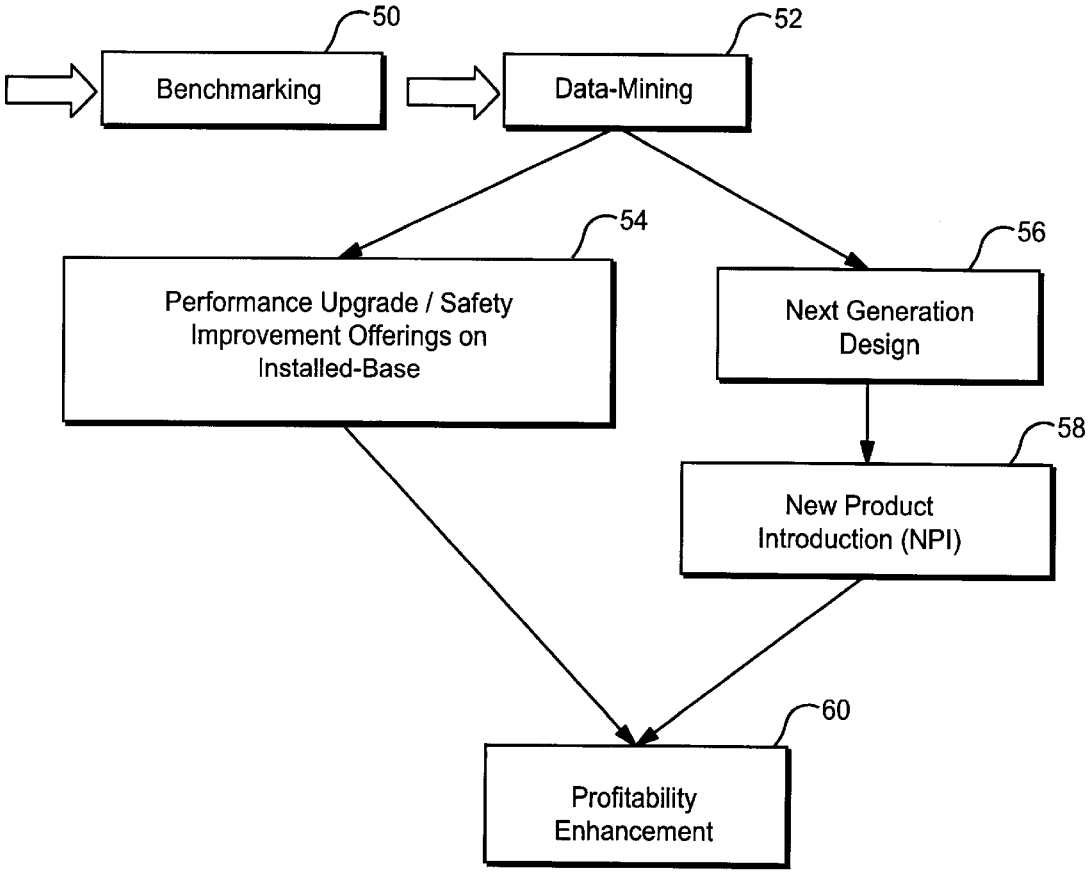
FIG. 4 illustrates the use of stall precursor data as in FIG. 1 to provide improved performance.

Comparison of measured pressure/velocity of gases flowing through compressor 14 to that of baseline compressor values is indicative of the operability of the compressor. This compressor operability data may be used to initiate the desired control system corrective actions to prevent a compressor surge, thus allowing the compressor to operate with a higher efficiency than if additional margin were required to avoid near stall operation. Stall precursor signals indicative of onset of compressor stall may also be provided, as illustrated in FIG. 4, to a display 64 or other indicator means so that an operator may manually initiate corrective measures to prevent a compressor surge and avoid near stall operation.

Figure 3:
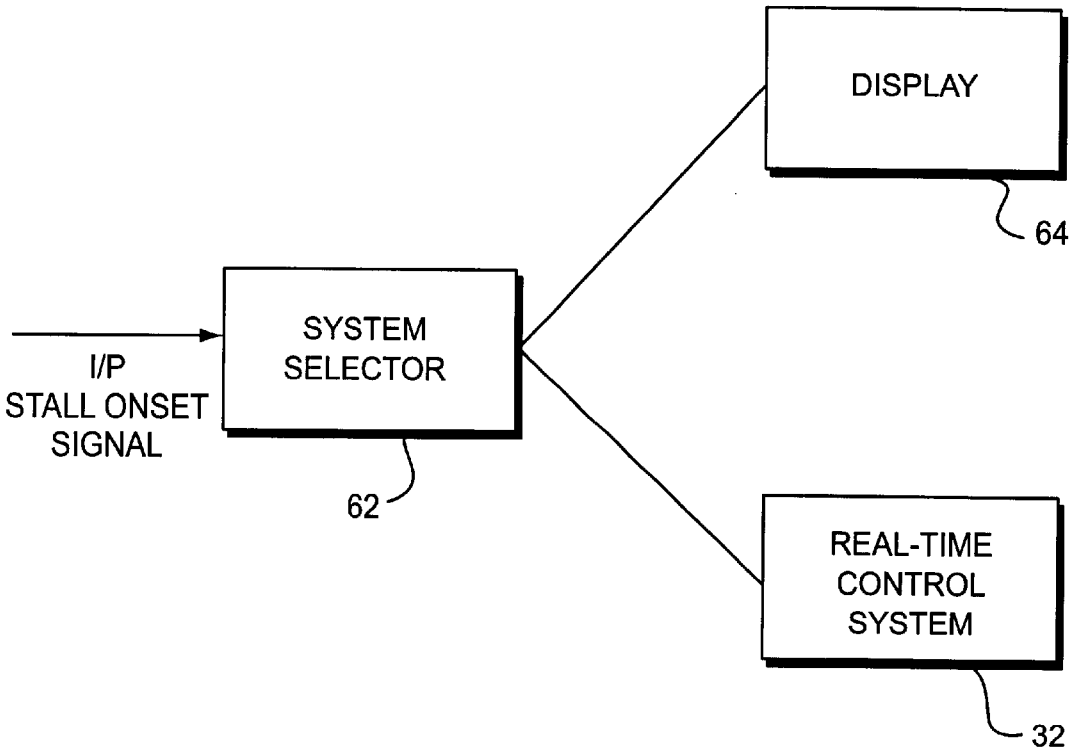
FIG. 3 illustrates a different embodiment of the present invention where a stall onset signal is applied to provide a visual indication.

Referring now to FIG. 3, there is shown in block diagram fashion, the use of stall precursor data as obtained in FIG. 2 to provide improved performance of compressor 14. Once stall precursor data is obtained from several gas turbines, in a manner similar to the operation as illustrated in FIG. 2, a bench-marking operation is performed as indicated at 50 on the received data to extract data to identify the feasibility of performance upgrades and safety improvement offerings as indicated at 54, thereby leading to enhancement in profitability. The extracted data as indicated at 52 may also be used for next generation designs which may likely lead to new products.

While the invention has been described in connection with what is presently considered to be the most practical and preferred embodiment, it will be understood that the invention is not to be limited to the disclosed embodiment, but on the contrary, is intended to cover various modifications and equivalent arrangements included within the spirit and scope of the appended claims.

What is claimed is:

1. A method for monitoring and controlling a compressor having at least one stage, comprising the steps of:

controlling the compressor in accordance with a predetermined operating line parameter;

monitoring the pressure of gases flowing through the at least one stage of the compressor;

determining at least one stall precursor value from the monitored pressure in the at least one stage;

comparing the at least one stall precursor value with predetermined baseline values to estimate compressor degradation;

performing a corrective action to mitigate compressor degradation to maintain a pre-selected level of compressor operability, wherein the corrective action includes varying the operating line parameter of the compressor; and iterating said corrective actions performing step until the monitored pressure lies within a predetermined threshold.

2. The method of claim 1 further comprises:

performing signal processing on the monitored pressure to obtain a filtered pressure signal; and storing the filtered signal in a memory.

3. The method of claim 2 wherein said corrective action includes varying a corrected speed line operating line parameter.

4. The method of claim 3 wherein said corrective action includes reducing the loading on the compressor.

5. The method of claim 4 wherein said operating line parameter is set to a near threshold value and the corrective action is to shift the operating line parameter away from the threshold value.

6. The method of claim 1 wherein said corrective actions are initiated by a real-time control system and real-time pressure monitoring system.

7. An apparatus for monitoring a compressor having at least one axial stage, comprising:

an array of pressure sensors mounted around the at least one axial stage and operatively coupled to measure the dynamic pressure of gases flowing through the compressor stage;

a processing system coupled to at least one sensor, said system recording and processing the pressure measurements made by at least one sensor, and said processing system generating a stall precursor value;

a comparator operatively coupled to said processor system to compare the stall precursor value with a predetermined baseline value; and a real-time controller coupled to the comparator, the controller initiating corrective actions to prevent a compressor surge if the stall precursor value deviates from said predetermined baseline value, wherein the corrective action includes varying an operating line parameter of said compressor.

8. The apparatus of claim 7 wherein the corrective action includes adjusting the operating limit line parameter away from a threshold surge or stall line value.

9. The apparatus of claim 8 wherein said operating limit line parameter is initially set to a near threshold value.

10. The system of claim 9 further comprises a system selector to selectively apply the sensor measurements to provide a visual warning of compressor degradation.

11. In a gas turbine having a compressor, a method for continuously monitoring and controlling surge events in the compressor, comprising the steps of:

controlling the compressor to operate along one or more predetermined operating lines;

monitoring the pressure of gases flowing through at least one stage the compressor at various positions in said stage;

comparing the monitored pressure with a predetermined baseline value to estimate compressor degradation;

performing a corrective action to mitigate compressor degradation to maintain a pre-selected level of compressor operability, wherein the corrective action includes adjusting the one or more predetermined operating lines of the compressor; and iterating said corrective actions performing step until the monitored pressure lies within a predetermined threshold.

12. The method of claim 11 wherein the corrective action includes moving the at least one operating line parameter away from a threshold value.

13. The method of claim 12 wherein the corrective actions further include varying the loading on the compressor.

14. The method of claim 13, wherein said operating line parameters are initially set to a near threshold value.

15. An apparatus for continuously monitoring and controlling an axial flow compressor system, comprising:

means for controlling the compressor to operate along one or more predetermined operating lines;

means for measuring the dynamic pressure of gases flowing through at least one stage of the compressor and at a plurality of positions around the stage;

means for processing the dynamic pressure measurements by at least one precursor detection algorithm to calculate a stall precursor signal magnitude;

means for comparing the stall precursor signal magnitude with a predetermined baseline stall value; and means for performing corrective action if the precursor stall signal magnitude deviates from said baseline stall value, wherein the corrective action includes varying the one or more operating lines.

16. The apparatus of claim 15 wherein corrective actions are initiated by varying operating limit line parameters.

17. A method for continuously monitoring and controlling an axial flow compressor, comprising the steps of:

providing a means for measuring the dynamic pressure of gases flowing through an axial stage of the compressor at a plurality of positions around the stage;

providing a means for processing the dynamic pressure measurements by at least one precursor detection algorithm to calculate current operating stall precursor signal magnitudes;

providing a means for comparing the current operating stall precursor signal magnitudes with a predetermined baseline stall value; and providing a means for performing a corrective action if the stall precursor signal magnitude deviates from said baseline value.

18. A stall precursor detector system for a gas turbine of the type having an axial flow compressor, the detector system comprising:

an array of pressure sensors mounted around at least one stage of the axial flow compressor and said sensors coupled to measure the dynamic pressure of gases flowing through the at least one stage of the compressor;

a processor system coupled to sensors, said processor system including a precursor detection algorithm for processing and comparing the dynamic pressure data from the sensors with predetermined baseline values for the operation of the compressor;

a comparator operatively coupled to said processor system to compare the sensor measurements with predetermined baseline values; and a real-time controller coupled to said comparator, the controller initiating corrective actions to prevent a subsequent compressor surge if the measured pressure values deviate from said predetermined baseline values.

* * * * *